US007413053B2

(12) United States Patent
Wasif et al.

(10) Patent No.: US 7,413,053 B2
(45) Date of Patent: Aug. 19, 2008

(54) ACOUSTIC RESONATOR WITH IMPINGEMENT COOLING TUBES

(75) Inventors: Samer P. Wasif, Oviedo, FL (US); Clifford E. Johnson, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 138 days.

(21) Appl. No.: 11/339,721

(22) Filed: Jan. 25, 2006

(65) Prior Publication Data

US 2007/0169992 A1 Jul. 26, 2007

(51) Int. Cl.
*G10K 11/02* (2006.01)

(52) U.S. Cl. ..... 181/293; 181/210; 181/211; 181/213; 181/292

(58) Field of Classification Search ..... 181/213, 181/295, 210, 211, 292, 293; 60/725, 804
See application file for complete search history.

(56) References Cited

U.S. PATENT DOCUMENTS

| | | | | |
|---|---|---|---|---|
| 3,715,009 | A | 2/1973 | Smith et al. | |
| 3,974,647 | A | 8/1976 | Lewis et al. | |
| 4,106,587 | A * | 8/1978 | Nash et al. | 181/213 |
| 4,277,765 | A | 7/1981 | Szecsi | |
| 5,353,598 | A | 10/1994 | Huck et al. | |
| 5,373,695 | A * | 12/1994 | Aigner et al. | 60/804 |
| 5,445,861 | A * | 8/1995 | Newton et al. | 428/116 |
| 5,463,873 | A | 11/1995 | Early et al. | |
| 5,489,202 | A | 2/1996 | Eisinger | |
| 5,512,715 | A * | 4/1996 | Takewa et al. | 181/295 |
| 5,644,918 | A | 7/1997 | Gulati et al. | |
| 5,685,157 | A | 11/1997 | Pandalai et al. | |
| 5,996,345 | A | 12/1999 | Hofler | |
| 6,182,787 | B1 | 2/2001 | Kraft et al. | |
| 6,351,947 | B1 | 3/2002 | Keller et al. | |
| 6,530,221 | B1 * | 3/2003 | Sattinger et al. | 60/725 |
| 6,546,729 | B2 | 4/2003 | Hellat et al. | |
| 6,705,428 | B2 | 3/2004 | Kudernatsch | |
| 6,837,051 | B2 * | 1/2005 | Mandai et al. | 60/725 |
| 6,973,790 | B2 * | 12/2005 | Suenaga et al. | 60/725 |
| 7,311,175 | B2 * | 12/2007 | Proscia et al. | 181/290 |
| 2004/0154860 | A1 | 8/2004 | Joost et al. | |
| 2004/0211185 | A1 | 10/2004 | Young et al. | |
| 2005/0223707 | A1 * | 10/2005 | Ikeda et al. | 60/725 |
| 2005/0284690 | A1 * | 12/2005 | Proscia et al. | 181/214 |

FOREIGN PATENT DOCUMENTS

| | | |
|---|---|---|
| EP | 1 434 006 A2 | 6/2004 |

* cited by examiner

*Primary Examiner*—Lincoln Donovan
*Assistant Examiner*—Jeremy Luks

(57) ABSTRACT

Aspects of the invention are directed to an acoustic resonator with improved impingement cooling effectiveness. The resonator includes a plate with an inside face and an outside face. A plurality of passages extend through the plate. The resonator includes a side wall that extends from and about the plate. A plurality of cooling tubes are attached to the resonator plate such that an inner passage of each cooling tube is in fluid communication with a respective passage in the resonator plate. The resonator can be secured to a surface of a turbine engine combustor component to define a closed cavity. The ends of the cooling tubes are spaced from the surface. Thus, a coolant can enter the passages in the plate and can be directed to the surface so as to impingement cool the surface. The cooling tubes can minimize coolant loss by dispersion in the cavity.

20 Claims, 7 Drawing Sheets

ACOUSTIC RESONATOR WITH IMPINGEMENT COOLING TUBES

FIELD OF THE INVENTION

The invention relates in general to devices for suppressing acoustic energy and, more particularly, to the use of such devices in power generation applications.

BACKGROUND OF THE INVENTION

The use of damping devices, such as Helmholtz resonators, in turbine engines is known. For instance, various examples of resonators are disclosed in U.S. Pat. No. 6,530,221, which is incorporated herein by reference. Resonators can dampen undesired frequencies of dynamics that may develop in the engine during operation.

One or more resonators can be attached to a surface of a turbine engine component, such as a combustor liner. The resonators are commonly attached to the component by welding. Some resonators can include a plurality of passages through which air can enter and purge the cavity enclosed by the resonator. One beneficial byproduct of such airflow is that the component to which the resonator is attached can be impingement cooled. That is, cooling air can pass through the passages and directly impinge on the hot surface underlying the resonator housing.

The operational demands of some engines have necessitated resonators with greater damping effectiveness, which can be achieved by increasing the size of the resonators. However, one tradeoff to these larger resonators is that the cooling holes becomes less effective in cooling the surface below, especially when resonator height is increased. As the distance between the impingement cooling holes and the hot surface beneath increases, greater amounts of cooling air can disperse within the closed cavity of the resonator without impinging on the hot surface. As a result, the impingement cooling holes become less effective in cooling the hot surface. Thus, there can be concerns of overheating of the component and/or the junction between the resonator and the component (i.e. welds), which can reduce the life cycle of these components.

Increased amounts of cooling air can be directed through the resonators. However, an increase in the coolant flow through the resonator can detune the resonator so that it will no longer dampen at its target frequency range. Alternatively, additional resonators can be provided on the component; however, adding more resonators at a sub-optimal location can provide less damping effectiveness than a larger resonator at an optimal location. Further, other design constraints may sometimes limit the ability to attach more resonators at other locations.

Thus, there is a need for a system that can maintain resonator cooling effectiveness.

SUMMARY OF THE INVENTION

Aspects of the invention are directed to an acoustic resonator. The resonator includes a resonator plate and at least one side wall extending from and about the resonator plate. The resonator plate has an outside face, an inside face, and a plurality of passages extending through the resonator plate from the inside face to the outside face. A plurality of cooling tubes extend from the inside face of the resonator plate. The cooling tubes have a first end, a second end and an inner passage. The cross-sectional size of the inner passage of at least one of the cooling tubes can decrease along at least a portion of the length of the cooling tube.

The first end of each cooling tube is operatively connected to the resonator plate such that the inner passage of each cooling tube is in fluid communication with a respective passage in the resonator plate. The length of each cooling tube is less than the length of the side wall. In one embodiment, each of the cooling tubes can have substantially the same length.

The cooling tubes can have various configurations and can be arranged in a number of ways. For instance, the cooling tubes can be substantially straight. The cooling tubes can extend at substantially 90 degrees relative to the resonator plate. In one embodiment, one or more of the cooling tubes can extend in a non-normal direction relative to the resonator plate. The plurality of cooling tubes can be bundled together.

In another respect, aspects of the invention are directed to an acoustic resonator system. The system includes a component and a resonator. The component has a surface and an associated thickness. The component can be, for example, a combustor liner or a transition duct. A plurality of passages extend through the thickness of the component. The resonator is attached to the surface so as to enclose at least some of the passages in the component. An interface is formed between the resonator and the surface, and a cavity is defined between the surface and the resonator.

The resonator includes a resonator plate and at least one side wall extending from and about the resonator plate. The resonator plate has an outside face and an inside face. A plurality of passages extend through the resonator plate from the inside face to the outside face.

A plurality of cooling tubes extend from the inside face of the resonator plate. Each of the cooling tubes has a first end, a second end and an inner passage. The first end of each cooling tube is operatively connected to the resonator plate such that the inner passage of each cooling tube is in fluid communication with a respective passage in the resonator plate. The second end of each cooling tube is spaced from the surface.

The cooling tubes can have numerous configurations and can be arranged in various ways. For instance, the cooling tubes can be substantially straight. The plurality of cooling tubes can be bundled. At least one of the cooling tubes can be positioned so that at least the second end of the cooling tube is directed toward the interface. In one embodiment, the cooling tubes can extend at substantially 90 degrees relative to the resonator plate. In another embodiment, at least one of the cooling tubes can extend in a non-normal direction relative to the resonator plate.

The cross-sectional size of the inner passage of at least one of the cooling tubes can decrease along at least a portion of the length of the cooling tube. An imaginary projection of the inner passage of one of the cooling tubes can be offset from the passages in the component. In some instances, the imaginary projection of the inner passage may not overlap any of the passages in the component.

In one embodiment, the system can include a second resonator. The second resonator can have a resonator plate that has an outside face, an inside face, and a plurality of passages extending through the resonator plate from the inside face to the outside face. At least one side wall can extend from and about the resonator plate. A plurality of cooling tubes can extend from the inside face of the resonator plate. The cooling tubes can have a first end, a second end and an inner passage. The first end of each cooling tube can be attached to the resonator plate such that the inner passage of each cooling tube is in fluid communication with a respective passage in the resonator plate. The second resonator can be attached to the surface so that a cavity is defined between the surface and the second resonator. The second end of each cooling tube can be spaced from the surface so that a coolant received in the tube can be discharged toward the surface. The length of the cooling tubes in the second resonator can be different from the length of the cooling tubes in the other resonator.

The system can further include a coolant, which can be air or an air-fuel mixture. The coolant can be received in the passages in the resonator plate and can flow through the cooling tube. The coolant exiting the cooling tube can impinge on the surface.

DETAILED DESCRIPTION OF EMBODIMENTS OF THE INVENTION

Embodiments of the invention are directed to resonators adapted to increase their cooling effectiveness. Aspects of the invention will be explained in connection with various resonator configurations, but the detailed description is intended only as exemplary. Embodiments of the invention are shown in FIGS. 1-5, but the present invention is not limited to the illustrated structure or application.

Figure 1:
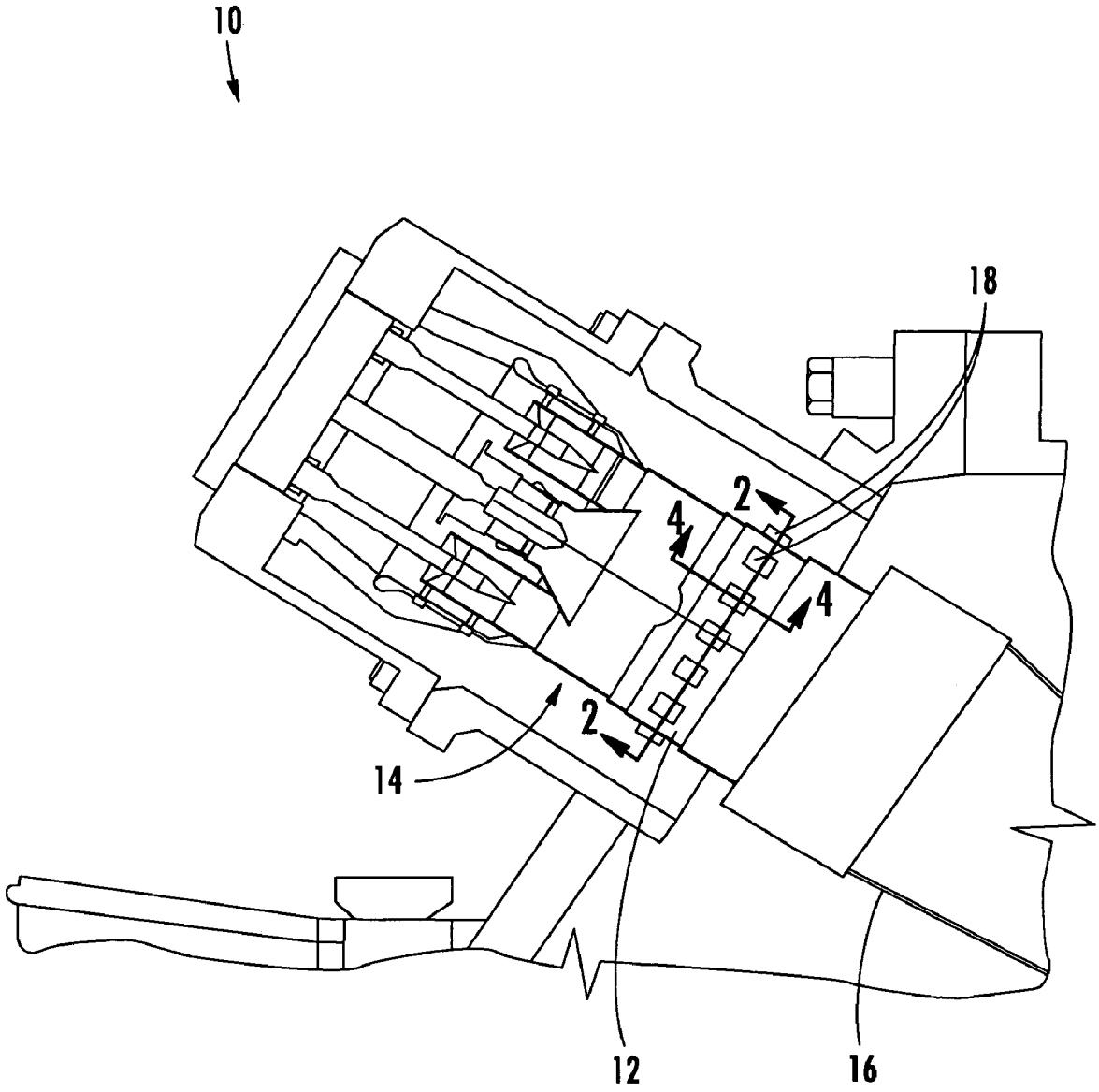
FIG. 1 is a cross-sectional view of the combustor section of a turbine engine, showing a plurality of resonators disposed about the periphery of the combustor component.

FIG. 1 shows an example of a portion of the combustor section 10 of a turbine engine. It should be noted that aspects of the invention can be applied to various turbine engine combustor systems including annular, can and can-annular combustors, just to name a few possibilities. Aspects of the invention are not intended to be limited to any particular type of combustor, turbine engine or application. As shown, one or more damping devices can be operatively connected to a surface 12 of a combustor component, such as a liner 14 or a transition duct 16. One commonly used damping device can be a resonator 18.

Referring to FIGS. 1, 4A, 4B and 5, the resonator 18 can provide a closed cavity 20 defined in part by a resonator plate 22 and at least one side wall 24 extending from and about the resonator plate 22. The resonator plate 22 can be substantially rectangular, but other geometries are possible, such as circular, polygonal, oval or combinations thereof. The resonator plate 22 can be substantially flat, or it can be curved. The resonator plate 22 can have an outside face 26 and an inside face 28; the terms "outside" and "inside" are intended to mean relative to the surface 12.

Figure 3A:
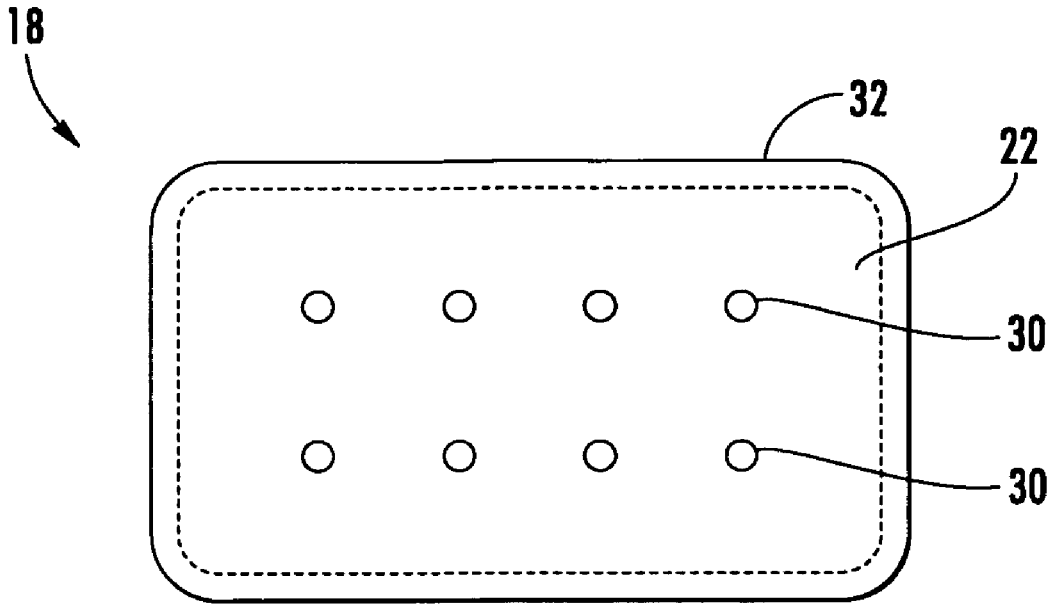
FIG. 3A is a top plan view of a resonator according to aspects of the invention, viewed from line 3A-3A of FIG. 2.

A plurality of passages 30 can extend through the resonator plate 22. The passages 30 can have any cross-sectional shape and size. For instance, the passages 30 can be circular, oval, rectangular, triangular, or polygonal. Ideally, each of the passages 30 has a substantially constant cross-section. Preferably, the passages 30 are substantially identical to each other. The passages 30 can be arranged on the resonator plate 22 in various ways. In one embodiment, the passages 30 can be arranged in rows and columns, as shown in FIG. 3A.

The side wall 24 can be provided in any of a number of ways. In one embodiment, the resonator plate 22 and the side wall 24 can be formed as a unitary structure, such as by casting or stamping. Alternatively, the side wall 24 can be made of one or more separate pieces, which can be attached to the resonator plate 22. For example, when the resonator plate 22 is rectangular, there can be four side walls 24, one side wall 24 extending from each side of the plate 22. In such case, the side walls 24 can be attached to each other where two side walls 24 abut.

The side wall 24 can also be attached to the resonator plate 22 in various places. In one embodiment, the side wall 24 can be attached to the outer periphery 32 of the plate 22. Alternatively, the side wall 24 can be attached to the inside face 28 of the resonator plate 22. Such attachment can be achieved by, for example, welding, brazing or mechanical engagement. In one embodiment, the side wall 24 can be substantially perpendicular to the resonator plate 22. Alternatively, the side wall 24 can be non-perpendicular to the resonator plate 22.

According to aspects of the invention, the resonators 18 can include a plurality of cooling tubes 34. Each cooling tube 34 can have a first end 36, a second end 38 and an inner passage 40. The cooling tubes 34 are preferably substantially straight, but, in some instances, the cooling tubes 34 can be curved, bent or otherwise non-straight.

There can be any quantity of cooling tubes 34. Preferably, there is a cooling tube 34 for each passage 30 in the resonator plate 22. In some instances, an individual cooling tube 34 can be in fluid communication with more than one passage 30 in the resonator plate 22.

Figure 4A:
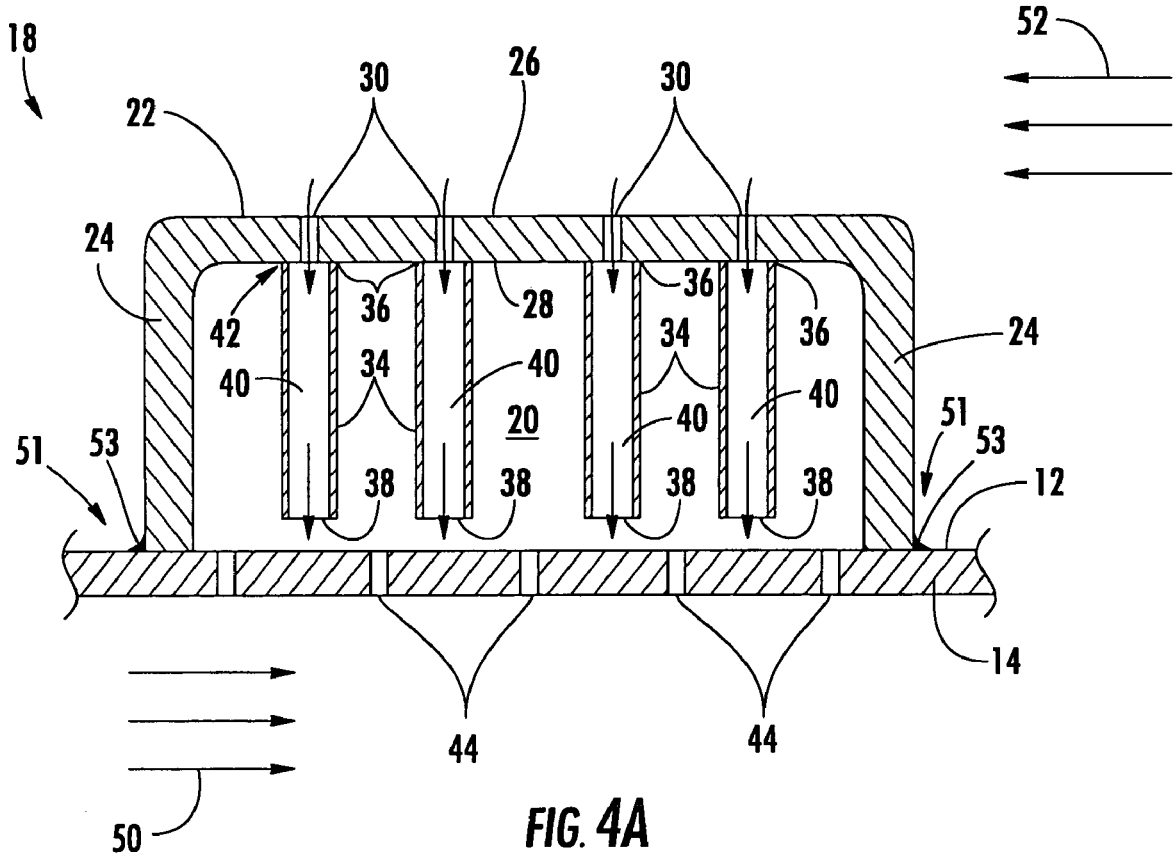
FIG. 4A is a cross-sectional view of a resonator on a combustor component according to aspects of the invention, viewed from line 4-4 in FIG. 1, showing the resonator having a plurality of cooling tubes.

The cooling tubes 34 can be operatively connected to the resonator plate 22 in various ways. Each cooling tube 34 can be attached at its first end 36 to the resonator plate 22 so as to be in fluid communication with a respective passage 30 in the resonator plate 22. In one embodiment, the cooling tubes 34 can be attached at their first ends 36 to the inside face 28 of the resonator plate 22, as shown in FIG. 4A. The cooling tubes 34 can be joined to and/or formed with the resonator plate 22 in various ways including, for example, by brazing, welding, mechanical engagement, machining, casting, or combinations thereof. An interface 42 can be formed between the cooling tubes 34 and the resonator plate 22. Preferably, the interface 42 is substantially sealed to avoid a leak path through which a coolant can escape.

Figure 4B:
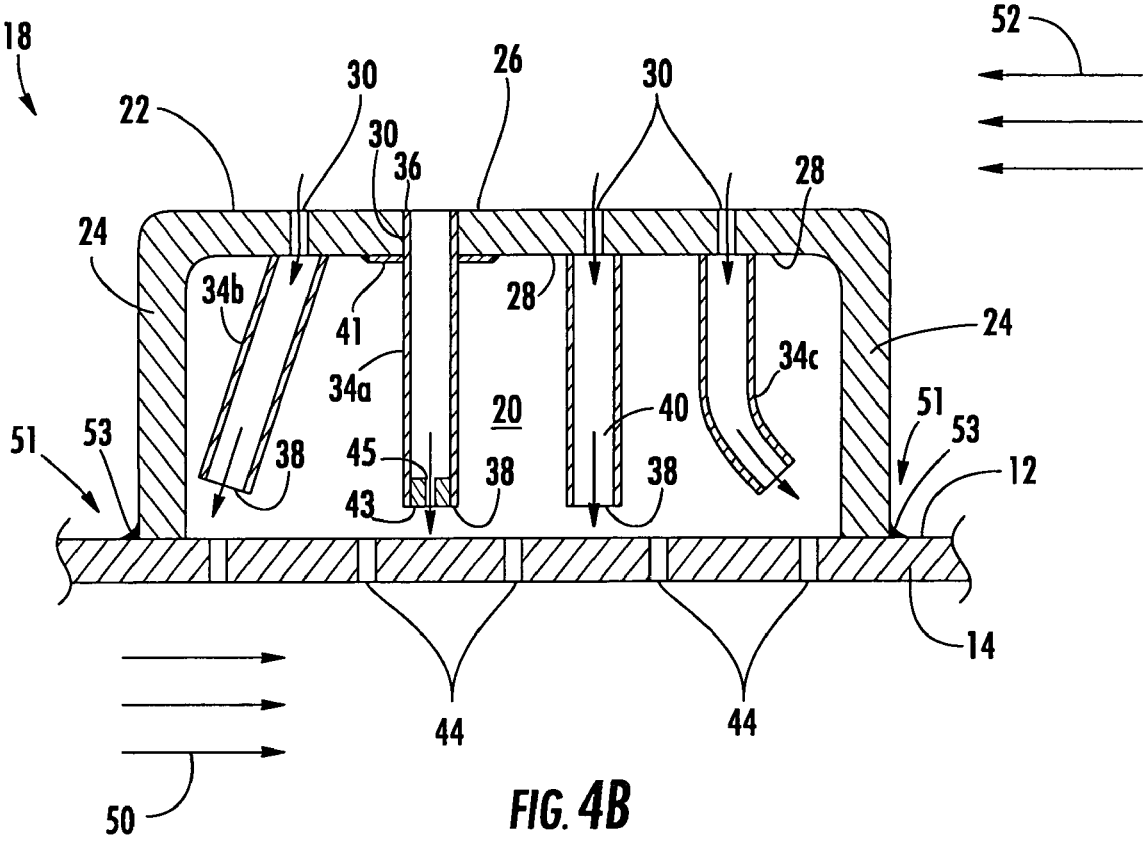
FIG. 4B is a cross-sectional view of a resonator on a combustor component according to aspects of the invention, viewed from line 4-4 in FIG. 1, showing alternative cooling tube configurations.
Figure 5:
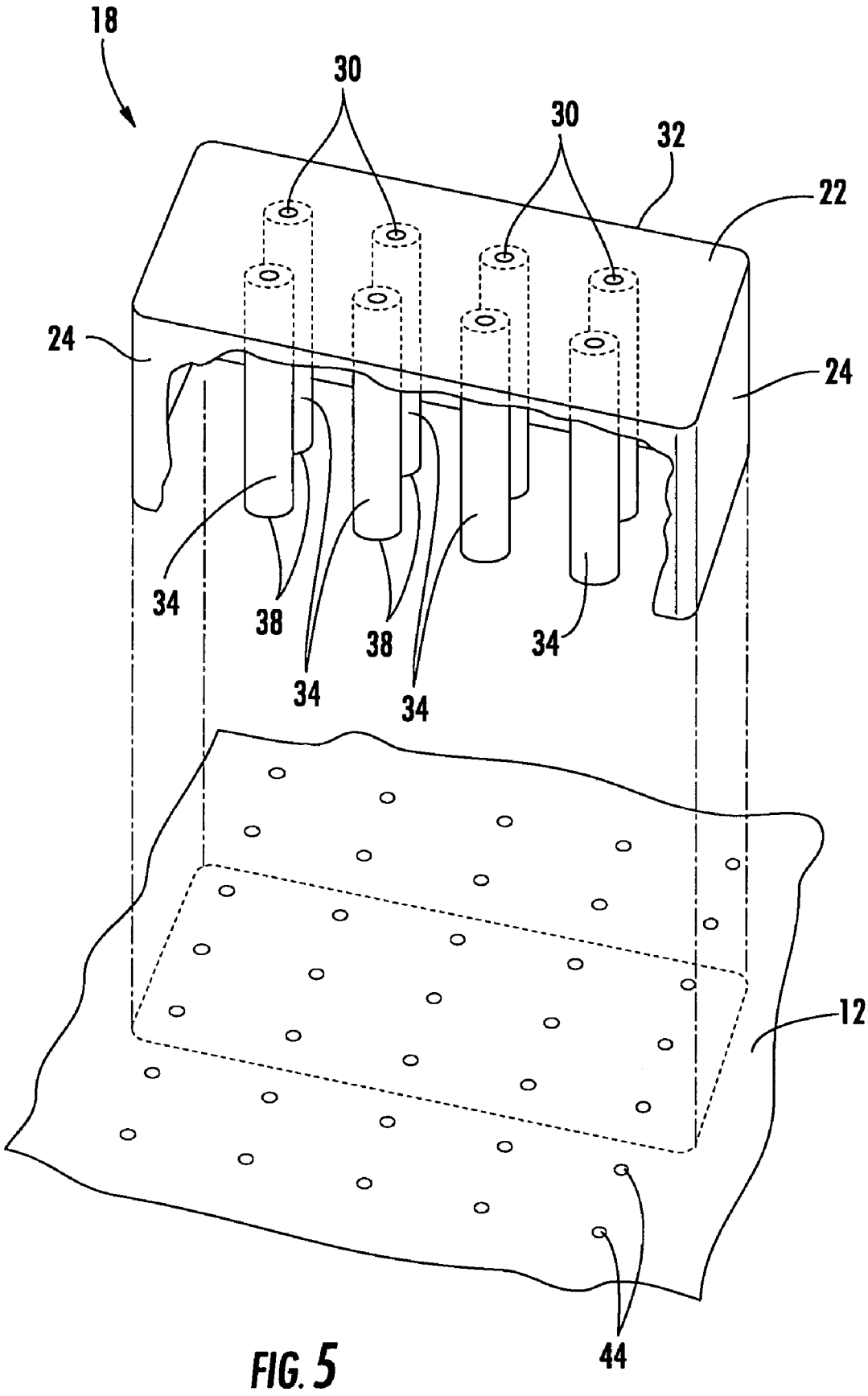
FIG. 5 is an isometric view of a resonator partially broken away, showing impingement cooling tubes according to aspects of the present invention.

In an alternative embodiment, a portion of the cooling tubes 34 including the first end 36 can be received within a respective passage 30 in the resonator plate 22, such as cooling tube 34*a* shown in FIG. 4B. In one embodiment, one or more cooling tubes 34*a* can be positioned such that the first end 36 is substantially flush with the outside face 26 of the resonator plate 22. In such case or when the first end 36 of the cooling tube 34*a* extends beyond the outside face 26, it will be appreciated that the inner passage 40 of the cooling tube 34*a* is not technically in fluid communication with a respective passage 30 in the resonator plate 22. Nonetheless, for purposes herein, it will be understood that such an arrangement is intended to be included when it is said that the inner passage 40 is in fluid communication with one of the passages 30 in the resonator plate 22.

One concern of such an arrangement is that the cooling tube 34*a* can become separated from the resonator plate 22 and exit through the passage 30 in the resonator plate 22 and enter the flow path in the combustor section 10. To minimize such an occurrence, a collar 41 can be attached to or formed with the cooling tube 34*a*. Naturally, the collar 41 is larger than the passage 30 in the resonator plate 22. Thus, the collar 41 bears against the inner surface 28 of the resonator plate 22, thereby preventing the cooling tube 34*a* from moving through the passage 30 in the resonator plate 22. The collar 41 can also be welded or otherwise attached to the inner surface 28 of the resonator plate 22. It will be understood that there are numerous ways for retaining the cooling tube 34*a* within the resonator 18, and aspects of the invention are not limited to the collar arrangement. For example, the cooling tube 34*a* can be connected to the resonator plate 22 by brazing, welding, mechanical engagement, machining, casting, or combinations thereof.

The cooling tubes 34 can have various cross-sectional sizes and shapes. For instance, the tubes 34 can be circular, rectangular, oblong, or polygonal, just to name a few possibilities. The inner passage 40 can be any suitable size. For instance, the cross-sectional size of the inner passage 40 can be equal to or greater than the size as the passages 30 in the resonator plate 22. In one embodiment, the cross-sectional size of the inner passage 40 of each tube 34 can be substantially constant along the length of the tube 34.

In some instances, the cross-sectional size of the inner passage 40 may not be constant. For instance, as shown by cooling tube 34*a* in FIG. 4B, there can be a reduction in the size of the inner passage 40 in at least one area of the inner passage 40. In such case, it is preferred if the reduction occurs at or near the second end 38 of the cooling tube 34*a*. In one embodiment, the reduction can be achieved by an insert 43 disposed along the inner passage 40. The insert 43 can be attached to the cooling tube by welding, brazing, mechanical engagement, and/or adhesives. The insert 43 can also be formed with the cooling tube, such as by casting or machining. The insert 43 can include a passage 45. The reduction or other change in cross-sectional size can be achieved in various ways, which will be readily recognized.

The cooling tubes 34 can be made of any suitable material. In one embodiment, the cooling tubes 34 can be made of the same material as the resonator plate 22. Preferably, the cooling tubes 34 are not permeable by air or other coolant being used. In one embodiment, as shown in FIGS. 4A and 4B, the cooling tubes 34 can be provided as a series of individual, unconnected tubes.

Figure 6:
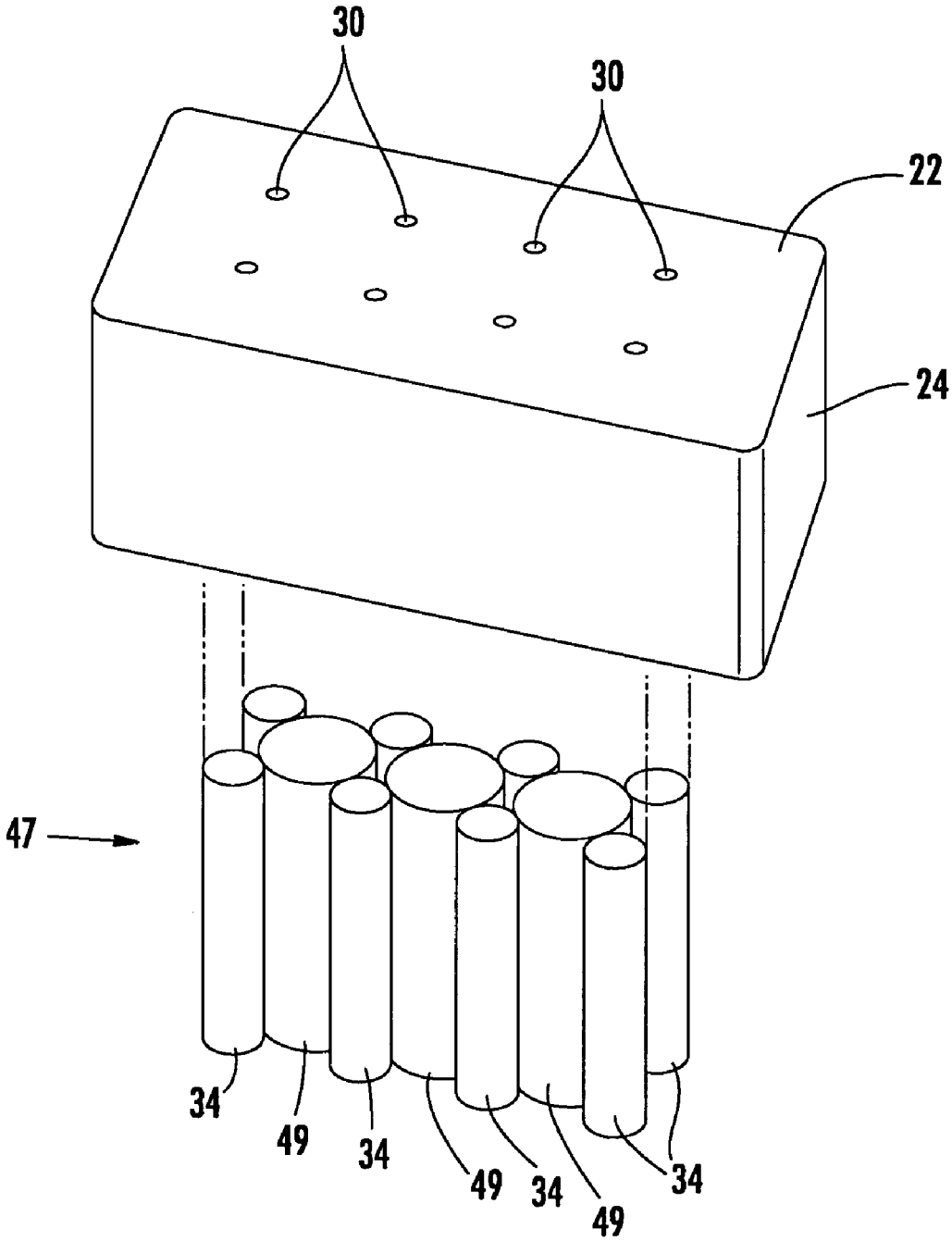
FIG. 6 is an isometric exploded view of a resonator assembly according to aspects of the invention, showing the cooling tubes provided as a bundle.

Alternatively, the cooling tubes can be provided together as a bundle 47, as shown in FIG. 6. Use of the term "bundle" and variations thereof is intended to mean that the plurality of cooling tubes 34 are held together in some manner. A bundled arrangement can strengthen the array of cooling tubes 34.

The cooling tubes 34 can be bundled in a variety of ways. In one embodiment, the cooling tubes 34 can be provided in a honeycomb-like arrangement (not shown). The cooling tubes 34 can be connected directly together, such as by welding, brazing, or machining. In one embodiment, the cooling tubes 34 can be indirectly connected to each other by way of an intermediate member. For example, in order to correctly position the cooling tubes 34 so that the inner passage 40 of each tube 34 is in fluid communication with a respective passage 30 in the resonator plate 22, the cooling tubes 34 can be separated by spacer tubes 49 or other spacer members. The cooling tubes 34 can be attached to the spacer tubes 49. The spacer tubes 49 can be sized and shaped as needed to achieve the desired position of the cooling tubes 34. The cooling tube bundle 47 can be attached to the resonator plate 22 or side wall 24. In some instances, the bundle 47 can remain unattached within the closed cavity of the resonator.

The cooling tubes 34 can be oriented in any of a number of ways relative to the resonator plate 22. In one embodiment, the cooling tubes 34 can extend at substantially 90 degrees relative to the resonator plate 22. In such case, the cooling tubes 34 can extend a substantial portion of the length of the side wall 24, but the cooling tubes do not extend the full length of the side wall 24. The length of the cooling tubes 34 can be determined for each application. However, for each resonator 18, all of the cooling tubes 34 can be substantially the same length.

The cooling tubes 34 can extend at non-normal angles to the resonator plate 22. Such an arrangement may be desired to provide cooling to at least a portion of an interface 51 between the resonator 18 and the surface 12, which can include welds 53. FIG. 4B shows examples of such cooling tubes arranged and/or adapted for such purposes. One or more cooling tubes 34*b* can be substantially straight, but it can extend away from the resonator plate 22 so that the second end 38 of the cooling tube 34*b* is directed toward the interface 51 or other desired cooling target. Alternatively, one or more cooling tubes 34*c* can be bent.

Figure 2:
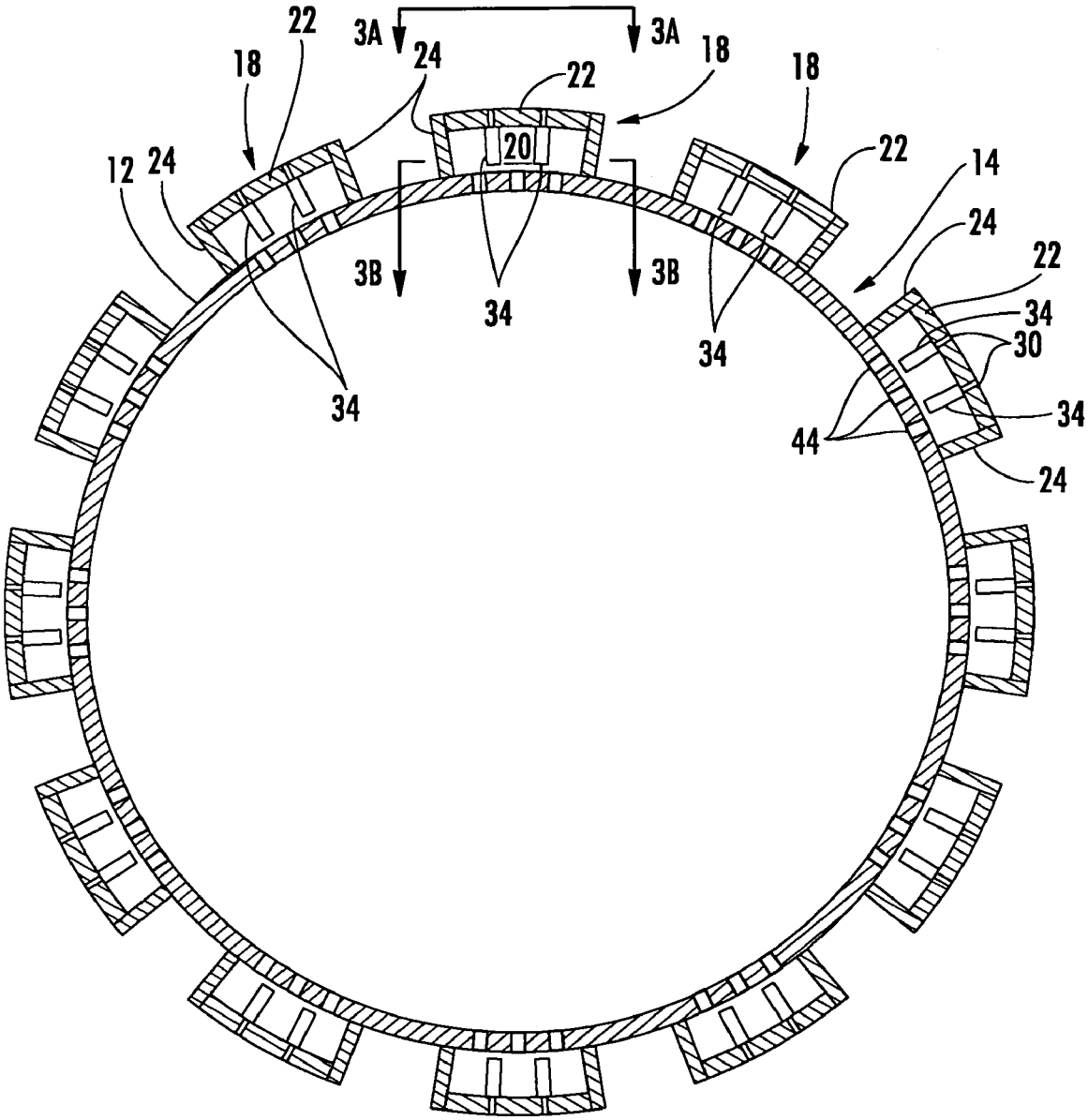
FIG. 2 is a cross-sectional view of a combustor component, viewed from line 2-2 of FIG. 1, and showing a plurality of resonators according to aspects of the invention disposed about the periphery of combustor component.

As shown in FIG. 2, one or more resonators 18 can be secured to the surface 12 of the combustor component by, for example, welding or brazing. In embodiments where there are a plurality of resonators 18, the resonators 18 can be arranged on and about the surface 12 of the combustor component in numerous ways, and aspects of the invention are not limited to any particular arrangement. It should be noted that, in the case of multiple resonators 18, the resonators 18 can be substantially identical to each other, or at least one resonator 18 can be different from the other resonators 18 in at least one respect. For instance, the plurality of cooling tubes 34 in one resonator 18 can have a first length, and the plurality of resonators in another resonator 18 can have a second length that is different from the first length.

The combustor component includes a plurality of passages 44 through its thickness. The resonator 18 can be attached to the surface 12 such that at least a portion of the passages 44 are enclosed by the resonator 18. It will be appreciated that the surface 12 can define one side of the closed cavity 20 of the resonator 18. Such an arrangement can minimize concerns of any of the cooling tubes 34 becoming separated from the resonator plate 22 during engine operation, which can result in significant damage if a cooling tube 34 entered the flow path in the combustor section 10.

As noted above, the cooling tubes 34 do not extend the full length of the resonator side wall; consequently, the cooling tubes 34 are entirely enclosed within the cavity 20. The second end 38 of each cooling tube 34 does not contact the surface 12 of the combustor component. That is, the second end 38 of each cooling tube 34 is spaced from the surface 12. The size of the spacing can be optimized for each application to achieve, among other things, the desired impingement cooling effect.

Figure 3B:
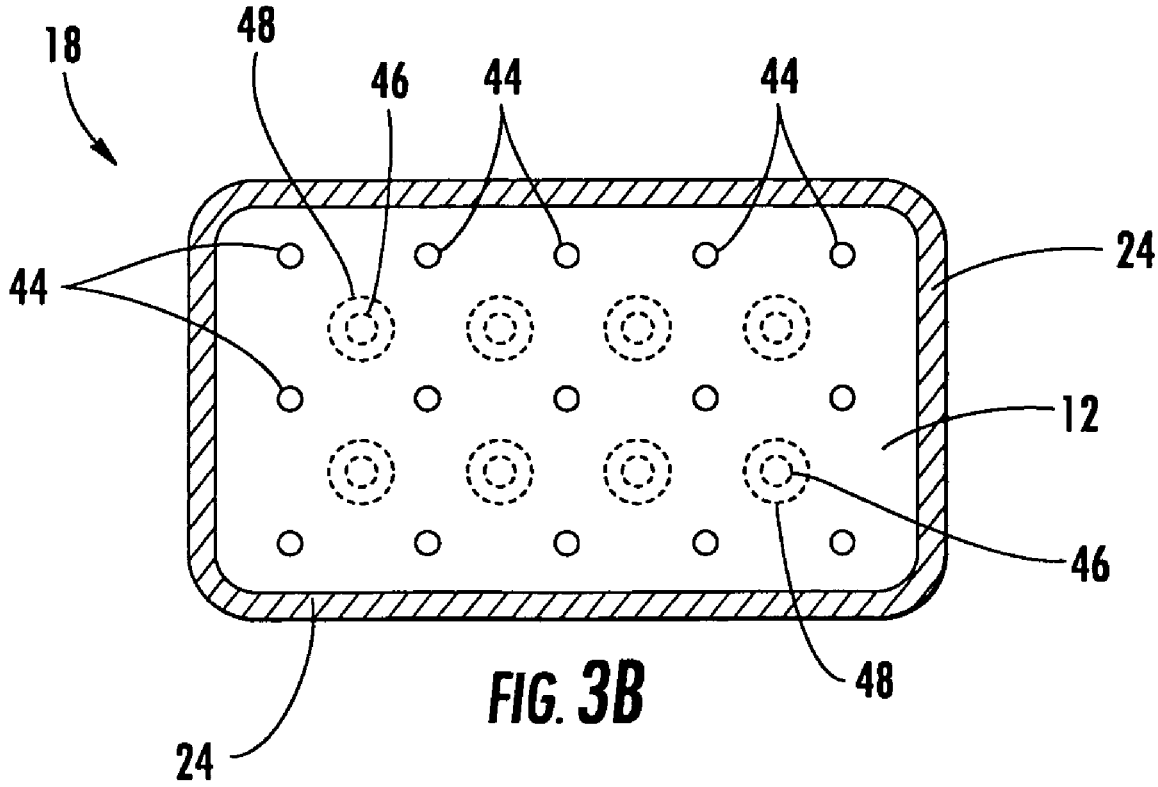
FIG. 3B is a cross-sectional view of a resonator according to aspects of the invention, viewed from line 3B-3B of FIG. 2.

In one embodiment, as shown in FIGS. 3A and 3B, the passages 30 in the resonator plate 22 can be arranged in X rows and Y columns, and the passages 44 in the combustor component can be arranged in X-1 rows and Y-1 columns. In this arrangement or in other arrangements, the passages 30 in the resonator plate 22 can be staggered or otherwise offset from the passages 44 in the combustor component. Likewise, the cooling tubes 34 can staggered or otherwise offset from the passages 44 in the combustor component. Offset is intended to mean that if an imaginary projection 46 of each resonator plate passage 30 and/or an imaginary projection 48 of the inner passage 40 were superimposed onto the surface 12, then the imaginary projections 46, 48 would not substantially overlap any of the passages 44 in the component, as illustrated particularly in FIG. 3B. That is, there would be minimal and, preferably, no overlap between the superimposed projections 46, 48 and the plurality of passages 44. However, embodiments of the invention are not limited to such offsetting arrangements.

Having described a resonator 18 according to aspects of the invention, one manner in which such resonators 18 can be used will now be described in connection with FIG. 4A. For purposes of this example, it will be assumed that the resonators 18 are attached to the surface 12 of the combustor liner 14. During engine operation, the temperature of the liner 14 increases as hot combustion gases 50 flow through it. Likewise, the interface 51 (which can include welds 53) can become heated. The liner 14 and the interface 51 must be cooled to maintain their integrity.

Any suitable coolant can be used to cool the liner 14. For instance, the coolant can be compressed air 52, which the combustor section 10 receives from the compressor section (not shown) of the engine. A portion of the compressed air 52 can enter the resonator 18 through the passages 30 in the resonator plate 22. Next, the air 52 can be directed along the cooling tubes 34 and exit through the second end 38 of the cooling tubes 34. The exiting air 52 can contact the surface 12 of the liner 14, thereby cooling the liner 14 by impingement cooling. As noted earlier, the cross-sectional size of the inner passage 40 of the cooling tubes 34*a* can decrease. Such a reduction in size can increase the velocity of a coolant traveling through the inner passage 40, which in turn can improve the cooling effect of the coolant exiting the tube 34*a* and impinging on the surface 12.

Again, it is preferred if the second ends 38 of the cooling tubes 34 are positioned to direct the exiting air 52 to a portion of the surface 12 that does not include the passages 44. Alternatively or in addition, the second end 38 of at least some of the cooling tubes 34 can be positioned to direct at least a portion of the exiting air 52 toward the interface 51 between the resonator 18 and the surface 12, as discussed earlier. Lastly, the cooling air 52 can exit the resonator 18 through the passages 44 in the liner 14, and join the combustion gases 50 flowing through the liner 14.

By preventing the air 52 from dispersing in the cavity 20 of the resonator 18 and by directing the air 52 to the surface 12, it will be appreciated that a resonator 18 according to aspects of the invention can improve the cooling effectiveness of the resonator 18. The resonators 18 can provide sufficient cooling to the liner 14 and/or the interface 51. As a result, resort to the use of additional resonators and greater amounts of the cooling air 52 can be avoided. Ideally, a resonator 18 equipped with cooling tubes 34 according to aspects of the invention will have little or no appreciable effect on the dampening function of the resonator 18.

It will be appreciated that the cooling tubes 34 according aspects of the invention can be used in connection with a variety of resonator designs including, for example, those disclosed in U.S. Pat. No. 6,530,221 and U.S. Patent Application Publication No. 2005/0034918, which are incorporated by reference. These references also describe the basic resonator operation in greater detail.

It should be noted that resonators according to aspects of the invention have been described herein in connection with the combustor section of a turbine engine, but it will be understood that the resonators can be used an any section of the engine that may be subjected to undesired acoustic energy. While aspects of the invention are particularly useful in power generation applications, it will be appreciated that aspects of the invention can be application to other applications in which turbine engines are used. Further, the resonator assemblies according to aspects of the invention can have application beyond the context of turbine engines to improve the cooling effectiveness of a resonator. Thus, it will of course be understood that the invention is not limited to the specific details described herein, which are given by way of example only, and that various modifications and alterations are possible within the scope of the invention as defined in the following claims.

What is claimed is:

1. An acoustic resonator comprising:

a resonator plate having an outside face, an inside face, and a plurality of passages extending through the resonator plate from the inside face to the outside face;

at least one side wall extending from and about the resonator plate; and a plurality of cooling tubes extending front the inside face of the resonator plate, the cooling tubes having a first end, a second end and an inner passage, wherein the first end of each cooling tube is operatively connected to the resonator plate such that the inner passage of each cooling tube is in fluid communication with a respective passage in the resonator plate, each of the plurality of cooling tubes having an associated length, wherein each of the plurality of cooling tubes has substantially the same length, wherein the length of each cooling tube is less than the length of the side wall.

2. The resonator of claim 1 wherein the cooling tubes are substantially straight.

3. The resonator of claim 1 wherein the cooling tubes extend at substantially 90 degrees relative to the resonator plate.

4. The resonator of claim 1 wherein at least one of the cooling tubes extends in a non-normal direction relative to the resonator plate.

5. The resonator of claim 1 wherein the plurality of cooling tubes are bundled.

6. The resonator of claim 1 wherein the cross-sectional size of the inner passage of at least one of the cooling tubes decreases along at least a portion of the length of the cooling tube.

7. An acoustic resonator system comprising:

a component having a surface and a thickness, wherein a plurality of passages extend through the thickness of the component;

a resonator including:

a resonator plate having an outside face, an inside face, and a plurality of passages extending through the resonator plate from the inside face to the outside face;

at least one side wall extending from and about the resonator plate; and a plurality of cooling tubes extending from the inside face of the resonator plate, each of the cooling tubes having a first end, a second end and an inner passage, wherein the first end of each cooling tube is operatively connected to the resonator plate such that the inner passage of each cooling tube is in fluid communication with a respective passage in the resonator plate, wherein the resonator is attached to the surface so as to enclose at least some of the passages in the component, an interface being formed between the resonator and the surface, and a cavity being defined between the surface and the resonator, and wherein the second end of each cooling tube is spaced from the surface.

8. The system of claim 7 wherein the component is one of a combustor liner and a transition duct.

9. The system of claim 7 wherein the cooling tubes are substantially straight.

10. The system of claim 7 wherein at least one of the cooling tubes is positioned so that at least the second end of the cooling tube is directed toward the interface.

11. The system of claim 7 wherein at least one of the cooling tubes extends in a non-normal direction relative to the resonator plate.

12. The system of claim 7 wherein the cooling tubes extend at substantially 90 degrees relative to the resonator plate.

13. The system of claim 7 further including a second resonator having:

a resonator plate having an outside face, an inside face, and a plurality of passages extending through the resonator plate from the inside face to the outside face;

at least one side wall extending from and about the resonator plate; and a plurality of cooling tubes extending from the inside face of the resonator plate, the cooling tubes having a first end, a second end and an inner passage, wherein the first end of each cooling tube is attached the resonator plate such that the inner passage of each cooling tube is in fluid communication with a respective passage in the resonator plate, wherein the second resonator is attached to the surface so that a cavity is defined between the surface and the resonator, the second end of each cooling tube being spaced from the surface, and wherein the length of the cooling tubes in the second resonator is different from the length of the cooling tubes in the resonator.

14. The system of claim 7 wherein an imaginary projection of the inner passage of one of the cooling tubes is offset from the passages in the component.

15. The system of claim 14 wherein the imaginary projection of the inner passage does not overlap any of the passages in the component.

16. The system of claim 7 further including a coolant, wherein the coolant is received in the passages in the resonator plate and flows through the cooling tube, wherein the coolant exiting the cooling tube impinges on the surface.

17. The system of claim 16 wherein the coolant is one of air and an air-fuel mixture.

18. The system of claim 7 wherein the plurality of cooling tubes are bundled.

19. The system of claim 7 wherein the cross-sectional size of the inner passage of at least one of the cooling tubes decreases along at least a portion of the length of the cooling tube.

20. An acoustic resonator comprising:

a resonator plate having an outside face, an inside face, and a plurality of passages extending through the resonator plate from the inside face to the outside face;

at least one side wall extending from and about the resonator plate; and a plurality of cooling tubes extending from the inside face of the resonator plate, the cooling tubes having a first end, a second end and an inner passage, wherein the first end of each cooling tube is operatively connected to the resonator plate such that each passage in the resonator plate is in fluid communication with the inner passage of a respective one of the cooling tubes, wherein the length of each cooling tube is less than the length of the side wall.

* * * * *